United States Patent [19]

Markwell et al.

[11] Patent Number: 4,632,217

[45] Date of Patent: Dec. 30, 1986

[54] AUTOMATICALLY ADJUSTABLE CLIMBING HARNESS

[76] Inventors: John H. Markwell, P.O. Box 53, Seneca Rocks, W. Va. 26884; Kyle Isenhart, Rt. 2, Box RS1, Little Hocking, Ohio 45742

[21] Appl. No.: 715,370

[22] Filed: Mar. 25, 1985

[51] Int. Cl.[4] ..... A62B 35/00

[52] U.S. Cl. ..... 182/3; 244/151 R

[58] Field of Search ..... 182/3–7; 244/151 R; 119/96

[56] References Cited

U.S. PATENT DOCUMENTS

| | | | |
|---|---|---|---|
| 1,775,736 | 9/1930 | Rose | 182/6 |
| 1,965,570 | 7/1934 | Binnie | 244/151 R |
| 1,967,767 | 7/1934 | Diez | 182/3 |
| 2,141,041 | 12/1938 | Knight | 244/151 R |
| 2,887,286 | 5/1959 | Moran | 244/151 R |
| 2,979,153 | 4/1961 | Hoagland et al. . | |
| 3,176,793 | 4/1965 | Hlacia . | |
| 3,258,788 | 7/1966 | Anciaux . | |
| 3,559,932 | 2/1971 | Ternes | 244/151 R |
| 4,121,688 | 10/1978 | Lirakis . | |
| 4,318,502 | 3/1982 | Lowe et al. . | |
| 4,410,175 | 10/1983 | Shamp | 182/3 |

FOREIGN PATENT DOCUMENTS

| | | | |
|---|---|---|---|
| 2529559 | 7/1975 | Fed. Rep. of Germany | 182/3 |
| 2824734 | 6/1978 | Fed. Rep. of Germany . | |
| 2905137 | 2/1979 | Fed. Rep. of Germany . | |
| 2930570 | 7/1979 | Fed. Rep. of Germany . | |
| 2292492 | 6/1976 | France . | |
| 2501048 | 9/1982 | France . | |
| 7413214 | 1/1975 | Netherlands | 182/3 |
| 137344 | 9/1952 | Switzerland . | |
| 142624 | 5/1920 | United Kingdom . | |
| 2039209 | 8/1980 | United Kingdom | 182/3 |

*Primary Examiner*—Ramon S. Britts
*Assistant Examiner*—Alvin Chin-Shue
*Attorney, Agent, or Firm*—Charles W. Fallow; Martin P. Hoffman; Mitchell B. Wasson

[57] ABSTRACT

A seat harness for mountain climbers is formed from a continuous length of woven fabric webbing having, at intervals, transverse slots formed therethrough by the weaving process. The leg loops of the harness are formed by passing the ends of the webbing through certain of its own slots. The leg loops are drawn snug while applying the harness; one size harness thus adapts to all leg sizes, avoiding the need for leg loop adjustment buckles. A chest harness formed of the same type webbing is also disclosed.

7 Claims, 5 Drawing Figures

AUTOMATICALLY ADJUSTABLE CLIMBING HARNESS

FIELD OF THE INVENTION

This invention relates to safety harnesses for mountain climbers.

BACKGROUND OF THE INVENTION

Mountain climbers, tree climbers, window washers and others frequently wear safety harnesses for obvious safety reasons. If the wearer should fall, a harness, tethered to a secure object, can arrest the fall and prevent injury. While the following discussion is confined to mountain climbing, for which this invention is primarily intended, the usefulness of the invention for other related purposes will be apparent.

It is common practice for mountain climbers to secure themselves, by means of a relatively elastic climbing rope tether, to chocks, pitons, screws or other devices placed in rock or ice along the climbing route. The free end of the rope is secured to a climbing harness so that in the event of a fall, the climber is arrested before striking a ledge or the like. The elasticity of climbing rope is such that, if used properly, the restraining upward force is low enough to halt the climber without doing injury to him. A seat harness is normally used; in addition, the use of chest harness is advisable to prevent back injuries that a belt harness alone can cause in a fall at certain body attitudes.

The climbing equipment industry is a highly technical, well developed one undergoing continuous change. Safety, weight, comfort and cost are among the factors by which new items of equipment are judged in the marketplace. Climbing harnesses themselves are well developed and enjoy a good safety record. While there are many different designs on the market and disclosed in the patent literature, a typical seat harness includes a waist belt connected to leg loops which pass through the crotch and under each hip. In an upright fall, the leg loops support most of the body weight, while the belt supports the weight at other attitudes. A typical arrangement is shown in German Offenlegungsschrift No. 2824734; others appear in U.S. Pat. Nos. 2,979,153, 3,176,793, 4,121,688, and 4,318,502. The last mentioned patent is typical of many seat harnesses on the market today in that the leg loops have adjustment buckles to accommodate users of various sizes. Thus, the leg loop webbing must be cut to size, or stocked in different sizes, for various users It would be advantageous to provide climbers with a seat harness having automatic leg loop adjustability. In this regard, U.S. Pat. No. 2,979,153 is of interest, for it shows a safety suit wherein the leg and shoulder loops are in effect nooses which constrict under tension to the wearer's dimensions.

In all of the prior art of which we are aware, harnesses formed from webbing have sewn seams whose strength may be critical. Not only can such seams provide weak points not even approaching in strength that of the webbing itself, the step of producing such seams also adds to manufacturing costs.

In view of the foregoing, an object of this invention is to provide climbers with a climbing seat harness having self-adjusting leg loops.

Another object is to avoid sewn seams in a climbing belt. A related object is to maximize the strength of web-to-web connections in a harness; another is to simplify the manufacture of the harness.

A further object of the invention is to produce the waist belt and both leg loops of a climbing belt from a single length of webbing, again, to simplify manufacture and improve harness strength.

SUMMARY OF THE INVENTION

We have accordingly developed a seat harness for mountain climbers, having simplified construction and automatic leg loop adjustment. According to our invention, a seat harness is formed from a single length of webbing, both of the leg loops and the waist belt being continuous. Each leg loop is formed by a length of webbing passing downward from the waist belt through the wearer's crotch, below his hip and outward around the upper thigh, terminating at a front portion crossing the body below the hips and common to each leg loop. The webbing from the waist belt passes through slots extending laterally through the webbing in the front piece, thus forming a noose which adjusts automatically to the wearer's leg size when the waist belt is tightened during application.

We have discovered a webbing material, previously used in other technical fields, that has proven especially useful for this construction, specifically, a nylon webbing normally used to construct cargo nets. This material, available from Murdock Webbing Company, Inc., Central Falls, R.I. satisfying Military Specification No. Mil 23223. Type 1, is approximately $1\frac{3}{4}''$ wide and has a breaking strength of 6500 lbs. The distinguishing feature of this material, which we have employed to advantage, is that it has transverse slots woven into it by the manufacturer. Thus, the strength of the slots does not depend on the strength of transverse stitching, which has previously been necessary to define slots in harness webbing. See U.S. Pat. No. 4,121,688 for an example of prior art construction, or the stitching closing the loops 22 in U.S. Pat. No. 2,979,153. Not only do the recurring slots (every eight inches of web length) greatly facilitate belt manufacture by making stitching steps unnecessary, they also have strength that would be difficult to duplicate by stitching. In one test, $\frac{3}{8}''$ diameter pins were placed in the slots and were then forced away from one another. Failure occurred at 5000 lbs. tension, nearly the breaking strength of the webbing itself.

DESCRIPTION OF THE PREFERRED EMBODIMENT

Figure 1:
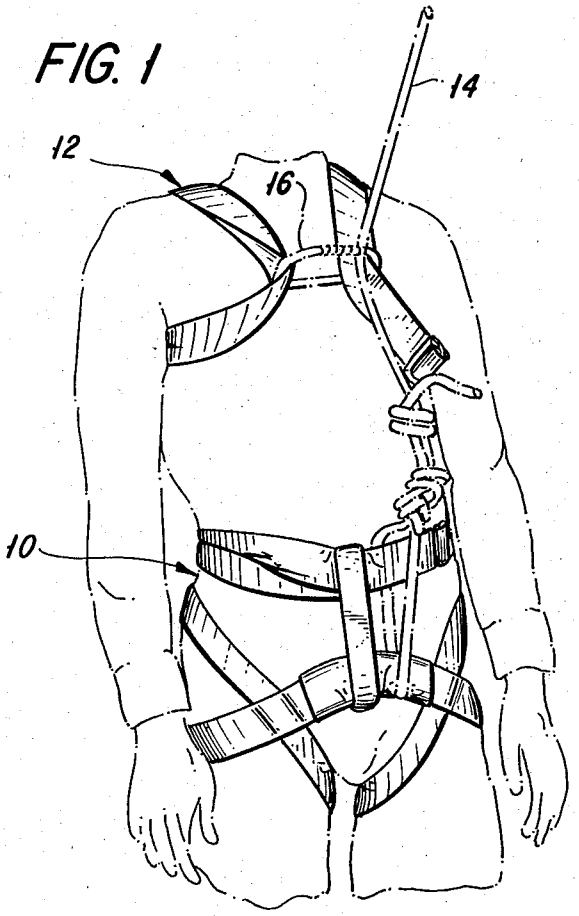
FIG. 1 is a front view of a seat harness and shoulder harness embodying the invention, with a climbing rope attached.
Figure 2:
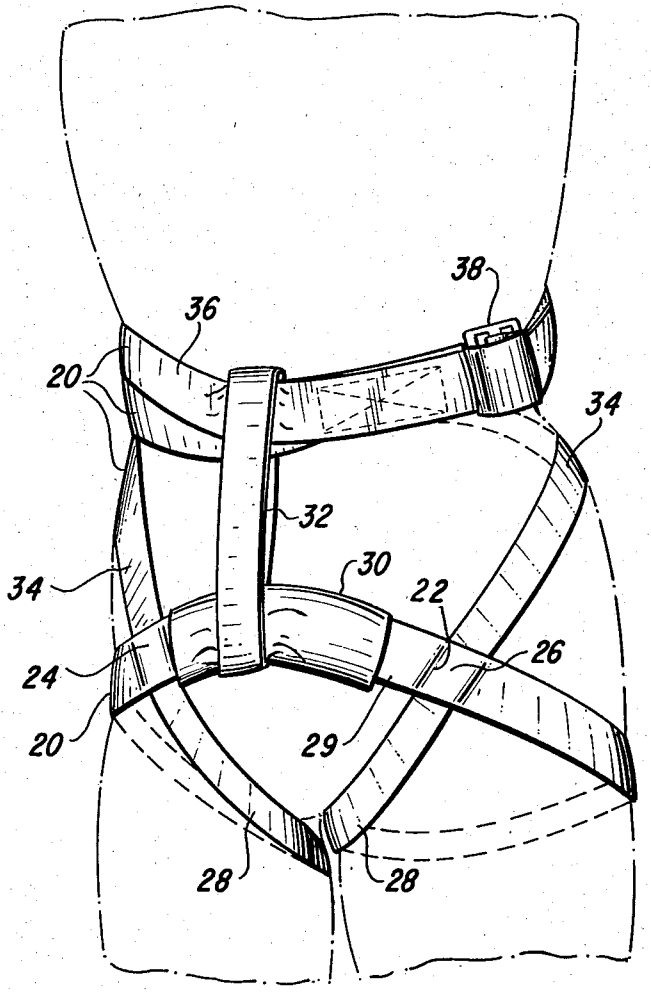
FIG. 2 is a front view of the seat harness shown in FIG. 1.

A seat harness 10 and a chest harness 12 embodying the invention are shown in FIG. 1, with a climbing rope 14 and carabiner clip 16 attached thereto. The seat harness 10, shown in greater detail in FIGS. 2 and 3, includes a single strap of nylon webbing 20 provided at intervals with transverse slots 22 such as at intersections 24 and 26. The slots bisect the thickness of the material, and have width sufficient to allow the webbing 20 itself to pass freely therethrough.

The webbing 20 is formed into two leg loops 28, interconnected by a short central segment 29, by passing respective ends of the webbing through the preformed slots at 24 and 26, an abrasion sheath 30 having first been placed over the central segment webbing, and a tie-in loop 32 having been positioned around the sheath. The free ends 34 of the webbing are wrapped around the user's waist to form a belt 36 and are then connected together by means of a buckle 38 attached by sewing 40 to one of the free ends 34.

Figure 3:
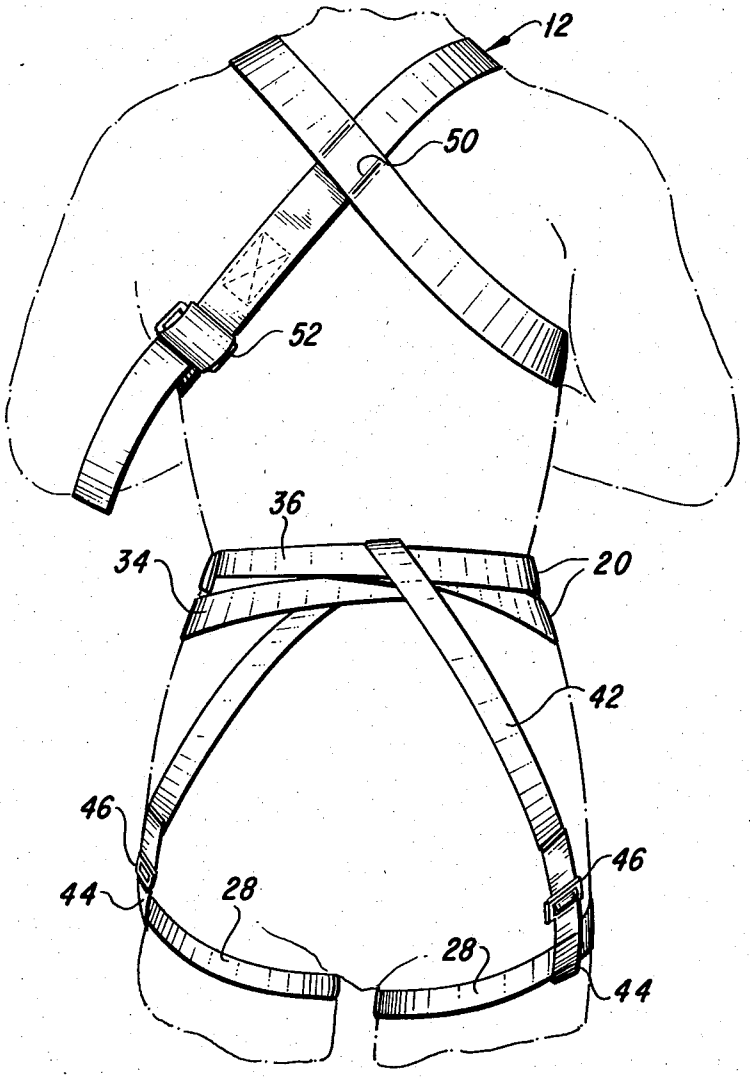
FIG. 3 is a rear view of the seat and shoulder harnesses illustrated in FIG. 1.

FIG. 3 shows a restraining strap 42 with loops 44 at either end defined by buckles 46; the loops 44 pass around the leg loops 28; the center of the strap passes over the back of the belt 36. The strap 42 does not support the wearer's body weight during a fall; rather, its function is to keep the leg loops from riding down the back of the legs. It is therefore of smaller size than the rest of the belt webbing.

FIG. 3. also shows the back of the chest harness 12, formed as a simple figure eight loop of the same webbing as is the seat harness. The webbing is passed through a slot at 50 to form the figure eight, at its ends by an adjustable buckle 52.

Figure 4:
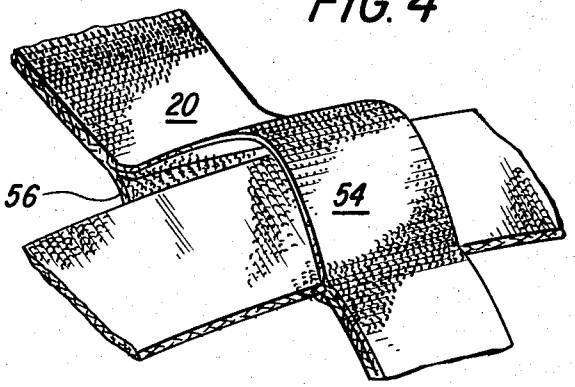
FIG. 4 depicts a segment of the webbing used to construct both the seat and shoulder harnesses, with another segment of webbing passing through the slot.
Figure 5:
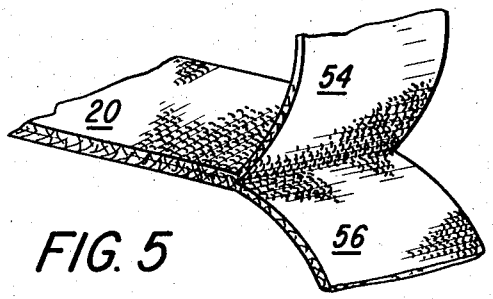
FIG. 5 shows in detail the woven slot construction of the webbing.

FIG. 4 shows in detail the intersection, such as at 24, 26 or 50, of two segments of the webbing used for the chest and seat harnesses. The webbing is cargo net material described in detail above under "SUMMARY OF THE INVENTION". FIG. 5 illustrates how the webbing 20 diverges into upper and lower halves 54, 56 at intervals, these halves being woven integrally with the remainder of the web. Note the absence of stitching.

To use the seat harness, one steps into the previously formed leg loops, grasping the free ends thereof in either hand. These ends are then drawn around the waist, preferably twice, through the tie-in loop 32 and are fastened together by the buckle 38. Bending over slightly while tightening the belt will assure a sung fit. The retaining strap can then be applied between the belt and the backs of the leg loops.

The chest harness is easily applied by inserting the arms through the loops of the figure eight. The carabiner clip is then installed between the shoulder loops, across the chest as shown, and the climbing rope is passed through the clip.

The climbing rope is attached to the seat harness by passing it downwardly beneath both the belt 36 and the sheath 30, then upwardly above the belt where the rope is tied off to itself in a standard manner.

While climbing, the free end of the rope is periodically secured by chocks or other standard devices so that if the climber falls, the rope and harness system will safely break his fall. If the climber's attitude is head up when the rope becomes taut, the rope load is borne primarily by the sheathed central segment. Leg constriction does not occur, even though the webbing may slide freely through slots 24 and 26, because the front piece sheath 30 is pulled upward and away from the legs by the rope tension. The sheath 30 protects the webbing underneath from rope abrasion under load. The tie-in loop is used to suspend various accessories from, and is not intended to support the full harness load.

The simplicity of the invention will be appreciated. The avoidance of leg loop adjustment buckles results in improved strength, comfort, manufacturing speed and adaptability. The disclosed new use of cargo net webbing advantageously obviates the need for stitching at several points; in fact, the only stitching in each harness is at the buckle securement points, which are not highly loaded.

Inasmuch as the invention is subject to modifications, variations and changes in detail, the embodiment described above should be regarded as only illustrative of the invention, whose scope is to be measured by the following claims.

We claim:

1. A climbing seat harness constructed from a single length of woven fabric webbing having plural transverse slots defined therein, said harness comprising a pair of leg loops, each formed by passing a respective end of the webbing freely through one of its own slots, whereby each loop is readily adjustable by pulling on the respective end, and a load-supporting central web segment at the front portion of the harness interconnecting the webbing slots forming the leg loops, whereby application of load to said segment transfers force to the legs without constricting the leg loops.

2. The harness recited in claim 1, further comprising a buckle attached to one end of said webbing, said buckle being adapted to receive the other end of said webbing to form said waist belt.

3. The harness recited in claim 1, further comprising a strap connected at its ends to each of said leg loops, the portion of said strap between the leg loops passing over said waist belt to limit downward movement of said leg loops.

4. The seat harness of claim 1, in combination with a shoulder harness also formed from a length of woven webbing having at least one transverse slot therein substantially bisecting the thickness of said webbing, said slot being defined solely by the weaving of the webbing.

5. The harness recited in claim 1, further comprising a waist belt formed by joining said ends of said webbing together.

6. The harness recited in claim 1, further comprising an abrasion sheath extending around said central segment to prevent wear thereof.

7. The harness recited in claim 6, further comprising a tie-in loop extending around said central segment, said sheath, and around a portion of said waist belt.

* * * * *